US010040523B2

(12) United States Patent
Lee

(10) Patent No.: US 10,040,523 B2
(45) Date of Patent: Aug. 7, 2018

(54) COMPRESSED AIR TANK FOR SINKING PREVENTION

(71) Applicant: Jeong Yong Lee, Hanam-si (KR)

(72) Inventor: Jeong Yong Lee, Hanam-si (KR)

( * ) Notice: Subject to any disclaimer, the term of this patent is extended or adjusted under 35 U.S.C. 154(b) by 0 days.

(21) Appl. No.: 15/119,729

(22) PCT Filed: Feb. 17, 2015

(86) PCT No.: PCT/KR2015/001669

§ 371 (c)(1),
(2) Date: Oct. 18, 2016

(87) PCT Pub. No.: WO2015/126184

PCT Pub. Date: Aug. 27, 2015

(65) Prior Publication Data

US 2017/0050708 A1 Feb. 23, 2017

(30) Foreign Application Priority Data

| | | |
|---|---|---|
| Feb. 19, 2014 | (KR) | 10-2014-0019369 |
| Feb. 20, 2014 | (KR) | 10-2014-0019948 |
| Apr. 18, 2014 | (KR) | 10-2014-0046347 |
| Apr. 24, 2014 | (KR) | 10-2014-0049051 |
| May 2, 2014 | (KR) | 10-2014-0053676 |
| Aug. 3, 2014 | (KR) | 10-2014-0099401 |
| Jan. 31, 2015 | (KR) | 10-2014-0015726 |

(51) Int. Cl.

| | |
|---|---|
| ***B63B 43/12*** | (2006.01) |
| ***B63G 13/00*** | (2006.01) |
| *B63B 17/04* | (2006.01) |

(52) U.S. Cl.
CPC ..... *B63B 43/12* (2013.01); *B63G 13/00* (2013.01); *B63B 2017/045* (2013.01); *B63B 2043/126* (2013.01)

(58) Field of Classification Search
CPC ..... B63B 43/12; B63G 13/00
(Continued)

(56) References Cited

U.S. PATENT DOCUMENTS 3,822,662 A * 7/1974 Morita ..... B63B 43/14 114/123
4,694,768 A * 9/1987 Aloisio ..... B63B 43/10 114/211
(Continued)

FOREIGN PATENT DOCUMENTS

EP 0568501 A1 11/1993
KR 10-2002-0052325 A 7/2002
(Continued)

OTHER PUBLICATIONS

International Search Report for PCT/KR2015/001669 dated Jun. 1, 2015 from Korean Intellectual Property Office.

*Primary Examiner* — Lars A Olson
*Assistant Examiner* — Jovon Hayes
(74) *Attorney, Agent, or Firm* — Revolution IP, PLLC

(57) ABSTRACT

A compressed air tank for sinking prevention comprises a compressed air tank having a valve; and an air pocket coupled to the compressed air tank and being filled with air discharged from the compressed air tank when the valve is opened, wherein buoyancy is provided to a cabin that is being flooded through the air pocket to prevent a ship from foundering.

12 Claims, 2 Drawing Sheets

(58) Field of Classification Search
USPC ..... 114/121–123
See application file for complete search history.

(56) References Cited

U.S. PATENT DOCUMENTS

| | | | | | |
|---|---|---|---|---|---|
| 5,215,031 | A * | 6/1993 | Inman | B63B 59/02 | 114/219 |
| 5,687,664 | A * | 11/1997 | Sofian | B63B 7/08 | 114/292 |
| 6,435,125 | B2 * | 8/2002 | Mears | B63B 43/14 | 114/345 |
| 6,470,818 | B1 * | 10/2002 | Mears | B63B 43/14 | 114/123 |
| 6,830,004 | B2 * | 12/2004 | Mears | B63B 43/14 | 114/123 |
| 7,509,920 | B2 * | 3/2009 | Taylor | B63B 59/02 | 114/343 |
| 8,136,467 | B2 * | 3/2012 | Powell | B63B 59/02 | 114/219 |
| 8,136,470 | B1 * | 3/2012 | Buescher | B63G 8/14 | 114/121 |
| 9,180,945 | B1 * | 11/2015 | Mears | B63C 7/00 | |
| 2017/0050708 | A1 * | 2/2017 | Lee | B63B 43/12 | |

FOREIGN PATENT DOCUMENTS

| | | | |
|---|---|---|---|
| KR | 10-2011-0005626 | A | 1/2011 |
| KR | 10-2012-0022243 | A | 3/2012 |
| KR | 10-2012-0091658 | A | 8/2012 |

* cited by examiner

[Fig. 1]
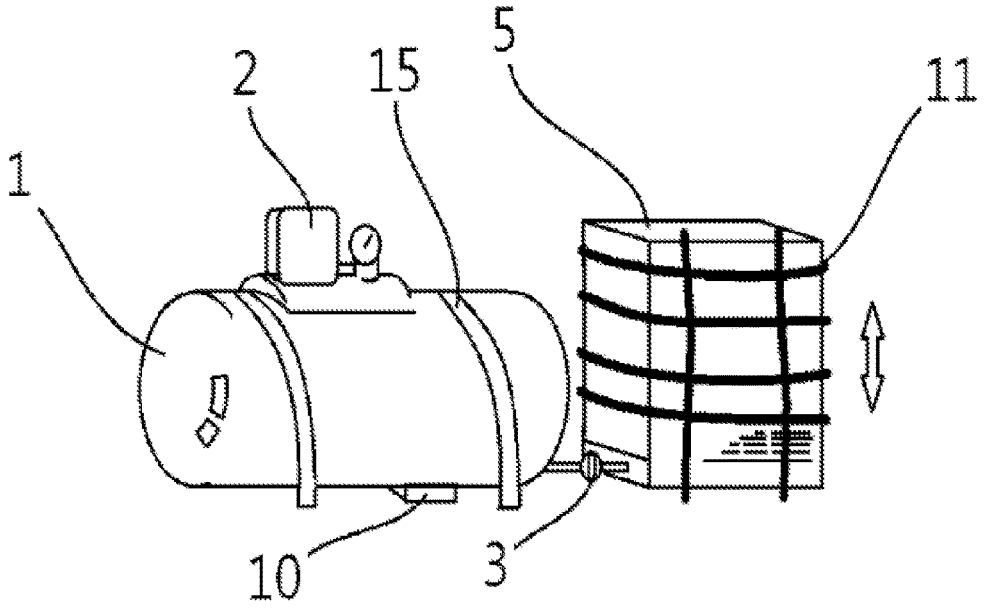
[Fig. 2]
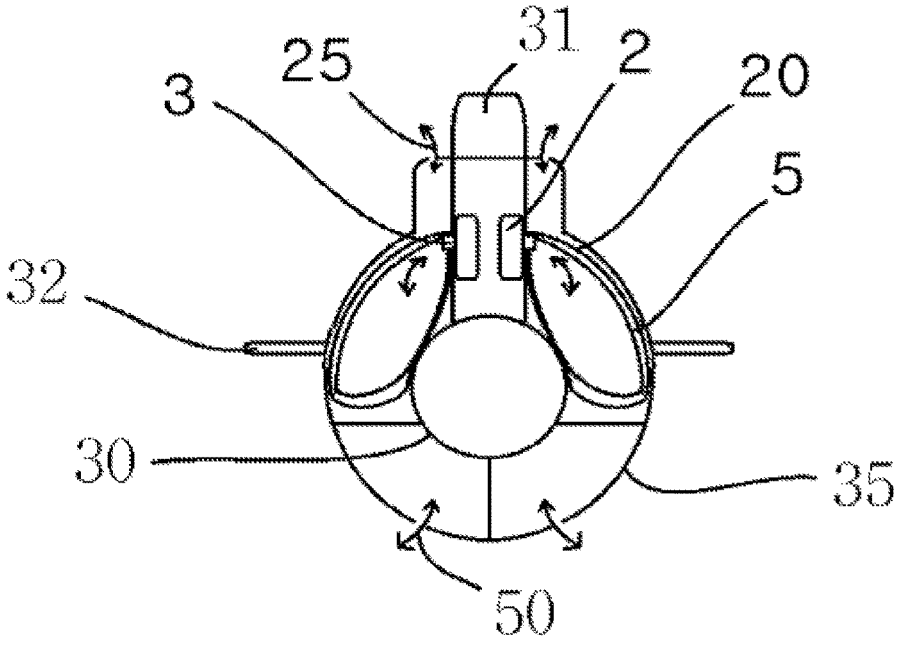

[Fig. 3]
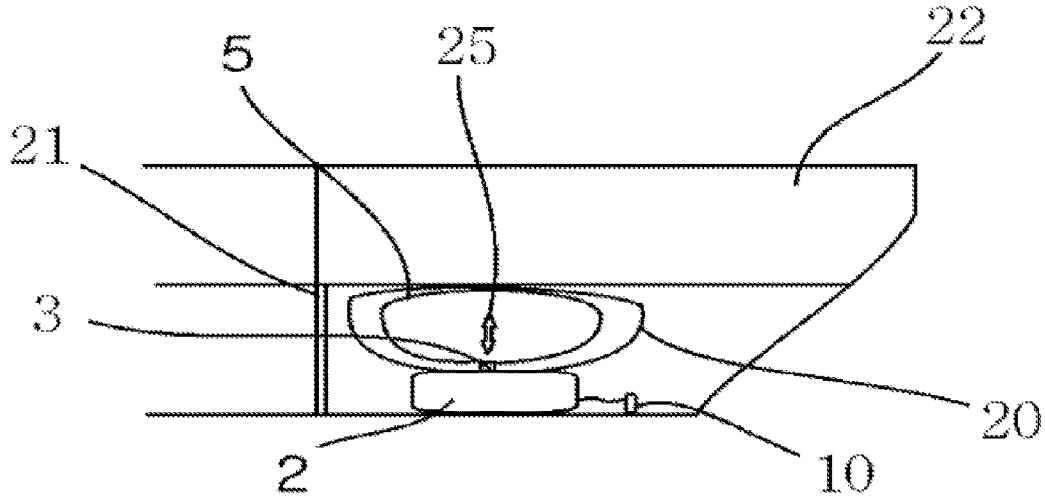

COMPRESSED AIR TANK FOR SINKING PREVENTION

TECHNICAL FIELD

The present invention relates to compressed air, an air compressor, a water sensor with or without a float switch, an air pocket, a carbon nanotube, and a servomotor etc.

BACKGROUND ART

An air compressor is a device that increases pressure by compressing air in a sealed container using a power source. An electric motor, a steam engine, and an internal combustion engine, etc. are used for the power source. Such power sources include a reciprocating type that reciprocates a piston, a rotary type that rotates a rotor, and a centrifugal rotary type that uses centrifugal force by blades that are rotated at high speed.

Compressed air is air with the volume decreased and the pressure increased by pressurization thereof. In everyday life, various types of work are performed using the force when high-pressure air decreases in pressure. For example, the force is used for ventilation of subways, mine drifts, and buildings.

The air pressure that is used in these cases is about 0.1 $kg/cm^2$ for ventilation of subways, drift mines, and buildings; about 0.5~1 $kg/cm^2$ for burning cokes in a furnace at a steelwork or a foundry; about 0.5~1 $kg/cm^2$ for delivering powder such as cement or pulverized coal or grains into a sealed pipe; about 7 $kg/cm^2$ for a pneumatic hammer, a pneumatic drill, and a rivet hammer, etc.; about 7 $kg/cm^2$ for the brake or a door engine of a train; and about 50 $kg/cm^2$ for spraying fuel in a diesel engine. Further, in other special cases, compressed air of 100~150 $kg/cm^2$ is used for sinking and floating of a submarine.

There is no possibility of ignition in a motor using compressed air, so it is used in a coal mine or a chemical factory where there is danger of explosion. The types of motors are classified into a steam engine type, a rotary radial crank type, a rotary radial cylinder type, a gear type, and a rotary blade type, etc.

A leak sensor, which is a sensor that senses water, senses whether water leaks or not.

The leak sensor generates a sensing signal by sensing the difference in frequency when there is water and there is no water on a floor in normal times.

A servomotor, which is an operating unit in a servo mechanism, is a device that controls loads in response to control signals. A servomotor is classified into an electric type (servo electric motor), a pneumatic type (pneumatic servomotor), and a hydraulic type (hydraulic motor) in accordance with the power source, and a servomotor usually means a servo electric motor.

A servo electric motor, which is an electric motor for control and which has high-speed response and a large speed control range, is classified into a DC servomotor and an AC servomotor in accordance with the power. Most AC servomotors are 3-phase servomotors.

These repeat stopping, starting, and backward operating, so they are designed to have high heat dissipation efficiency or to quickly change the operation. Servomotors are operated in response to control signals, and for this purpose, they require a device that receives and amplifies control signals, and the device is called a servo amplifier.

A manometer is a device for measuring the pressure of gas or liquid and there are various types of manometers, depending on the use, such as a barometer, a pressure difference meter, a high pressure gauge, and a vacuum gauge.

Depending on the measuring principle, for example, there is a manometer that measures pressure using balance with the weight of a substance such as liquid, an elastic manometer that measures pressure using the degree of bending of a pressed elastic body, and a gauge that uses predetermined physical properties that are changed by pressure.

A U-tube manometer formed by filling a glass tube with water, mercury, or alcohol is representative of the manometer. When an end of the tube is connected to an object to be measured, the liquid moves up or down to the position where it equilibrates with a pressure change between both ends of the tube. In this state, it is possible to measure the pressure difference between both ends on the basis of the height difference of the liquid at the left and right sides of the tube. There are an open type and a closed type, both of which have wide measurable ranges.

A mercury barometer is not a U-shaped pipe, but is a closed type barometer that is the same in terms of the principle of operation. A type of mechanically enlarging movement of a float on liquid or converting the movement into an electric amount is used in the engineering field.

Further, the elastic pressure gauge is relatively widely used for the industry and measures pressure by mechanically enlarging transformation of a pressure-receiving member made of metal, etc. There are a bourdon tube pressure gauge, a diaphragm pressure gauge, and a bellows pressure gauge (including an aneroid manometer), etc. These pressure gauges are simple to handle and have a wide measurement range, but they have a common deficit that the elasticity of the pressure-receiving member has little hysteresis and has non-uniform transformation to pressure, and that the transformation is increased when pressure is applied for a long period of time.

Further, the vacuum gauge is a device for measuring pressure under atmospheric pressure, and other than the manometer or the elastic pressure gauge, there are special pressure gauges such as a Macleod gauge, a pirani gauge, and an ionization gauge that measure changes in thermal conductivity or ionization degree of gas due to changes in pressure.

A deadweight gauge is a kind of high-pressure pressure gauge that measures pressure using a weight. The deadweight gauge measures pressure by making equilibrium between the pressure, which is generated by oil such as coal oil taken into a cylinder with a piston therein and pushes up the bottom of the piston, and the sum of the weight of the piston and a weight on the piston. Such a deadweight gauge can measure high pressure that the manometer cannot measure, and is used for correcting the scale of other pressure gauges.

Further, as high-pressure gauges that measure high pressure of fluid, there are a compression pressure gauge, a resistance pressure gauge, and a bourdon tube pressure gauge, etc.

DISCLOSURE

Technical Problem

An object of the present invention is to provide basic alternative plans for various reasons that cause ships to sink.

According to an interview with an expert on the sinking of the MV Sewol that sank on Apr. 16, 2014, it was reported that, "According to reports, the ship started listing to the left and then completely overturned, they said like this, then what kind of accident can overturn such a big ship in this way?" The expert claimed, "I think there are three reasons: First, apparently several bulkheads tore and water flowed into many spaces. As I got and checked a plan of the ship, the bottom space of the ship was divided into several compartments by waterproof bulkheads. And, only one space filled with water cannot break the balance. So, there is a possibility several bulkheads tore and many spaces were flooded at the same time in this accident. Second, it is a case there are pathways through which water flows to upper decks in the spaces. Or, there may be pathways in some of the cases through which water can flow to upper decks. According to the plan I got, some of the spaces are connected through stairs, and when the spaces are damaged, water can flow to upper decks.

Third, it is a case in which spaces are not divided. There is a space for loading vehicles on the deck. Such a space is wide and not divided by walls. When the ship hits a sunken rock with a side and the side is damaged, stability may decrease a lot even if the damage is small."

An object of the present invention is to provide basic alternative plans for these three cases.

Further, an object of the present invention is to provide basic plans that can secure time for escaping when a ship capsizes. When a ship sinks in shallow water, even if overturned, air collects in the upper space and there may be spaces where people can survive. However, the most important reason for the large loss of lives in the accident of MV Sewol is that the ship quickly tilted and there was not enough time for the people to escape.

This is because in such big ships, spaces are not divided by bulkheads and are widely spread, and the space for loading vehicles or freight is also one space in most cases, so if the space leaks, the vessel quickly loses its balance and overturns as compared with other merchant vessels.

Technical Solution

By combining compressed air, an air compressor, a water sensor with or without a float switch, an air pocket, a carbon nanotube, and a servo motor, etc, a water sensor senses that a ship is flooded, compressed air in a compressed air tank is sprayed, the sprayed air fills the air pocket, and the ship does not sink, but rather floats by the buoyancy generated by the air in the air pocket.

A compressed air tank for sinking prevention of the present invention includes: a compressed air tank having a valve; and an air pocket coupled to the compressed air tank and being filled with air discharged from the compressed air tank when the valve is opened, in which buoyancy is provided to a cabin that is being flooded through the air pocket to prevent a ship from foundering.

The compressed may include: a pressure sensor on the compressed pressure tank; a switch operating when pressure at a predetermined level or less is sensed by the pressure sensor; an actuator operating an air compressor to compress and keep the air in the compressed air tank under predetermined pressure when the switch is operated; and a controller controlling electrical signal from the pressure sensor, in which when pressure inputted to the controller from the pressure sensor is a predetermined level or less, the controller may output an electrical signal for compressing air and the air compressor may compress and keep the air in the compressed air tank under predetermined pressure.

The air pocket may be disposed in a vehicle and may prevent the vehicle from sinking by providing buoyancy to the vehicle in an emergency.

The compressed air tank may include: a water sensor for sensing flooding when a ship starts being flooded by hitting a sunken rock or by leaking; a switch being turned on when the water sensor senses flooding; a servomotor being operated by the switch to fill the air pocket with air by opening the valve of the compressed air tank; the controller receiving an electric signal that is generated when the water sensor senses flooding; and the actuator for operating the valve of the compressed air tank, the valve being opened by the servomotor that is operated by the controller, in order to prevent foundering by providing buoyancy to a cabin that is being flooded.

The compressed air tank may include: in a place except for an inside of bulkheads, or a fuel tank, a pure water tank, or a bilge well keeping waste water of a dual bottom of a ship equipped with a float switch, a water sensor sensing flooding; a switch automatically operating the servomotor for operating a valve of a ballast when electricity is connected by the water sensor; and a discharge unit discharging water inside the bulkheads as much as an inflated volume of the elastic air pocket by operating the servomotor so that the valve of the ballast tank opens, compressed air is discharged, and the air pocket connected to the ballast tank inflates, when doors on the bulkheads are closed, a switch on the bulkheads is turned on after the doors on the bulkheads are closed, or a switch in a steering house is turned on, after air in the ballast tank is compressed by an air compressor.

The compressed air tank may include: in order to discharge water in a cabin defined by bulkheads or a space inside a hull, where water is not normally discharged, in a submarine to a normal level, the float switch automatically operating the servomotor for operating the valve of the ballast tank when flooding of a cabin defined by the bulkheads is sensed; the switch opening the ballast tank capable of discharging air using the servomotor, when doors on the bulkheads are closed, a switch on the bulkheads is turned on after the doors on the bulkheads are closed, or a switch in a control room is turned on, after the air in the ballast tank is compressed by the air compressor; an air discharger coupled to the ballast tank to discharge the compressed air; and the discharge unit discharging air inside the bulkheads by inflating the elastic air pocket connected to the ballast tank.

The air pocket may be covered with an outer cover made of a carbon nanotube to be prevented from being damaged by utensils and objects in the cabin.

The compressed tank may include a switch unit receiving a signal through the controller and operates a relay or a motor so that a switch of the air compressor is turned off and the air compressor is not operated regardless of a pressure change of the compressed air tank, when the water sensor senses flooding.

One or more fixing frames may be formed at a side in the ship and an air compressor-fixing unit fixed to the fixing frames may be provided.

A net may be formed on the air pocket or the carbon nanotube so that people can move, holding the net in an emergency.

The compressed air tank may include an emergency power supply equipped with a built-in charger for supplying power to operate the servomotor opening the valve of the compressed air tank when the water sensor is operated with power cut in an emergency.

An air pocket, a sodium azide capsule, iron oxide, and a detonator may be provided instead of the compressed air tank, and when a vehicle is flooded and a water sensor with or without a float switch senses flooding, a switch may be turned on, a current may operate an igniter in a gas generator, intensive heat may be instantaneously generated and may generate a flame, and the sodium azide capsule may be blown up to make reaction with the iron oxide, whereby a nitrogen gas produced by decomposition of the sodium azide into sodium and nitrogen may inflate the air pocket.

Further, there is provided a compressed air tank for sinking prevention formed by combining the configuration of claim 12 with the configuration of any one of claims 1 to 11.

Advantageous Effects

According to the present invention, it is possible to provide basic alternative plans for cases when compartments are broken at the same time and many spaces are flooded, when there are pathways through which water can flow to upper decks, when spaces are not divided by bulkheads, and when there is no time for passengers to escape.

DESCRIPTION OF DRAWINGS

FIG. 1 is a perspective view of the present invention.

FIG. 2 is a cross-sectional view of an embodiment when the present invention is applied to a submarine.

FIG. 3 is a cross-sectional view of an embodiment when the present invention is applied to a ship.

MODE FOR INVENTION

The present invention is described in detail with reference to the drawings. FIG. 1 is a perspective view of the present invention. In normal times, when a pressure gauge measures pressure at a predetermined level or less in a compressed air tank (1), a switch is operated and air in the compressed air tank (1) is compressed by an air compressor (2), thereby maintaining predetermined pressure.

If a ship (22) starts leaking and sinks due to, for example, hitting a sunken rock, a water sensor (10) with or without a float switch senses flooding and then the switch is turned on. A servomotor starts operating in response to a sensing signal from the water sensor (10) and opens a valve (3) of the compressed air tank, so the air in the compressed air tank (1) is discharged and fills an air pocket (5). Accordingly, the air pocket (5) inflates and provides buoyancy to the sinking cabin, thereby preventing the ship (22) from foundering. The air pocket (5) is covered with an outer cover made of a carbon nanotube (20) so that it can be prevented from being damaged by utensils and objects in the cabin. When the water sensor (10) senses that the ship (22) is being flooded, the switch of the air compressor (2) is turned off so that the air compressor (2) is not operated even if the internal pressure of the compressed air tank (1) changes. Further, a net (11) is formed on the air pocket (5) or the carbon nanotube (20) so that people can move, holding the net (11).

FIG. 2 is a cross-sectional view of an embodiment when the present invention is applied to a submarine (31). In the submarine (31), a discharging unit is formed for a cabin defined by bulkheads (21) in order to discharge water in the cabin or a space inside the hull, where water is not normally discharged, to a normal level using a float switch. That is, when a float switch senses flooding, doors on the bulkheads (21) are automatically closed, a switch is operated after the doors on the bulkheads are closed, or a switch in the control room is turned on.

Accordingly, the servomotor is operated and opens a valve (3) of a ballast tank, the compressed air is discharged, an elastic air pocket (5) connected to the ballast tank through an air discharger inflates, so the water in the cabin is discharged.

FIG. 3 is a cross-sectional view of an embodiment when the present invention is applied to a ship (22). A float switch is provided and an exit is formed at a place with air except for the inside of bulkheads (21) or, a fuel tank, a pure water tank, or a bilge well keeping waste water inside a bulkhead or in the lower compartment of a dual bottom of the ship (22).

That is, there is formed a discharge unit that automatically closes doors on the bulkheads (21), operates a switch after closing the doors on the bulkhead, or operates a switch in a steering house so that the servomotor is operated and opens a valve (3) of a ballast tank, the compressed air is discharged, and the elastic air pocket (5) connected to the ballast tank through the air (25) discharger inflates, thereby discharging water inside the bulkheads.

The invention claimed is:

1. A Compressed air tank for sinking prevention, comprising:

a compressed air tank having a valve; and an air pocket coupled to the compressed air tank and being filled with air discharged from the compressed air tank when the valve is opened, wherein buoyancy is provided to a cabin that is being flooded through the air pocket to prevent a ship from foundering, wherein the air pocket is covered with an outer cover made of a carbon nanotube to be prevented from being damaged by utensils and objects in the cabin.

2. The compressed air tank of claim 1, further comprising:

a pressure sensor on the compressed pressure tank;

a switch operating when pressure at a predetermined level or less is sensed by the pressure sensor;

an actuator operating an air compressor to compress and keep the air in the compressed air tank under predetermined pressure when the switch is operated; and a controller controlling electrical signals from the pressure sensor, wherein when pressure inputted to the controller from the pressure sensor is a predetermined level or less, the controller outputs an electrical signal for compressing air and the air compressor compresses and keeps the air in the compressed air tank under predetermined pressure.

3. The compressed air tank of claim 1, wherein the air pocket is disposed in a vehicle and prevents the vehicle from sinking by providing buoyancy to the vehicle in an emergency.

4. The compressed air tank of claim 1, comprising:

a water sensor for sensing flooding when a ship starts being flooded by hitting a sunken rock or leaking;

a switch being turned on when the water sensor senses flooding;

a servomotor being operated by the switch to fill the air pocket with air by opening the valve of the compressed air tank;

the controller receiving an electric signal that is generated when the water sensor senses flooding; and the actuator for operating the valve of the compressed air tank, the valve being opened by the servomotor that is operated by the controller, in order to prevent foundering by providing buoyancy to a cabin that is being flooded.

5. The compressed air tank of claim 1, comprising: in a place except for an inside of bulkheads, or a fuel tank, a pure water tank, or a bilge well keeping waste water of a dual bottom of a ship equipped with a float switch, the water sensor sensing flooding;

the switch automatically operating the servomotor for operating a valve of a ballast when electricity is connected by the water sensor; and a discharge unit discharging water inside the bulkheads as much as an inflated volume of the elastic air pocket by operating the servomotor so that the valve of the ballast tank opens, compressed air is discharged, and the air pocket connected to the ballast tank inflates, when doors on the bulkheads are closed, a switch on the bulkheads is turned on after the doors on the bulkheads are closed, or a switch in a steering house is turned on, after air in the ballast tank is compressed by the air compressor.

6. The compressed air tank of claim 1, comprising: in order to discharge water in a cabin defined by bulkheads or a space inside a hull, where water is not normally discharged, in a submarine to a normal level, the float switch automatically operating the servomotor for operating the valve of the ballast tank when flooding of a cabin defined by the bulkheads is sensed;

the switch opening the ballast tank capable of discharging air using the servomotor, when doors on the bulkheads are closed, a switch on the bulkheads is turned on after the doors on the bulkheads are closed, or a switch in a control room is turned on, after the air in the ballast tank is compressed by the air compressor;

an air discharger coupled to the ballast tank to discharge the compressed air; and the discharge unit discharging air inside the bulkheads by inflating the elastic air pocket connected to the ballast tank.

7. The compressed tank of claim 1, comprising a switch unit receiving a signal through the controller and operates a relay or a motor so that a switch of the air compressor is turned off and the air compressor is not operated regardless of a pressure change of the compressed air tank, when the water sensor senses flooding.

8. The compressed air tank of claim 1, wherein one or more fixing frames are formed at a side in the ship and an air compressor-fixing unit fixed to the fixing frames is provided.

9. The compressed air tank of claim 1, comprising a net formed on the air pocket or the carbon nanotube so that people can move in an emergency by holding the net.

10. The compressed air tank of claim 1, comprising an emergency power supply equipped with a built-in charger for supplying power to operate the servomotor opening the valve of the compressed air tank when the water sensor is operated with power cut in an emergency.

11. The compressed air tank of claim 1, wherein an air pocket, a sodium azide capsule, iron oxide, and a detonator are provided instead of the compressed air tank, and when a vehicle is flooded and a water sensor with or without a float switch senses flooding, a switch is turned on, a current operates an igniter in a gas generator, intensive heat is instantaneously generated and generates a flame, and the sodium azide capsule is blown up to make reaction with the iron oxide, whereby a nitrogen gas produced by decomposition of the sodium azide into sodium and nitrogen inflates the air pocket.

12. A compressed air tank for sinking prevention formed by combining the configuration of claim 11 with the configuration of claim 1.

* * * * *